United States Patent [19]

Simpson

[11] 4,366,656

[45] Jan. 4, 1983

[54] ROOF PANEL ASSEMBLIES FOR FORMING WEATHERPROOF STANDING SEAM JOINTS AND THE LIKE AND METHODS OF JOINING STANDING SEAM ROOF PANELS

[75] Inventor: Harold G. Simpson, Oklahoma City, Okla.

[73] Assignee: The Wickes Corporation, San Diego, Calif.

[21] Appl. No.: 183,717

[22] Filed: Sep. 3, 1980

[51] Int. Cl.[3] ..... E04F 15/14

[52] U.S. Cl. ..... 52/395; 52/520; 52/528; 52/465

[58] Field of Search ..... 52/461–470, 52/394, 395, 748, 529, 520, 472, 478, 528, 542

[56] References Cited

U.S. PATENT DOCUMENTS

| | | | |
|---|---|---|---|
| 205,188 | 6/1878 | Horrie | 52/466 |
| 537,569 | 4/1895 | Flatau | 52/748 |
| 2,405,643 | 8/1946 | Crot | 52/471 |
| 3,444,661 | 5/1969 | Santho | 52/364 |
| 3,535,844 | 10/1979 | Glaros | 52/595 |
| 3,667,180 | 6/1972 | Tischuk | 52/309.2 |
| 4,106,250 | 8/1978 | Cummings et al. | 52/394 |
| 4,155,209 | 5/1979 | Schirmer | 52/468 |
| 4,168,596 | 9/1979 | Yoder | 52/462 |
| 4,196,554 | 4/1980 | Anderson et al. | 52/394 |

FOREIGN PATENT DOCUMENTS

| | | | |
|---|---|---|---|
| 963461 | 1/1950 | France | 52/465 |

*Primary Examiner*—James L. Ridgill, Jr.
*Attorney, Agent, or Firm*—Learman & McCulloch

[57] ABSTRACT

A standing seam roof panel joint assembly for standing seam roofs includes a pair of upstanding seam forming mating walls at the side edges of adjacent roof panels which may be interlocked and embraced by a cap strip. These walls of each panel are formed with opposed complementary pockets located substantially the same distance down from their upper ends, adjacent reversely bent contiguous wall sections which are embraced by the cap strip. Mastic or "hot melt" beads of predetermined volume are disposed in the pocket in each wall section, and distributed when the pockets are deformed during the seaming operation in which the seam forming edges are interlocked.

24 Claims, 6 Drawing Figures

11
11b
C
10b
S
10
P
9
17b
11a
12'
15a
17a
17
10a
12
18
19
A
17c
10

ROOF PANEL ASSEMBLIES FOR FORMING WEATHERPROOF STANDING SEAM JOINTS AND THE LIKE AND METHODS OF JOINING STANDING SEAM ROOF PANELS

BACKGROUND OF THE INVENTION

The present invention relates to standing seam roof constructions of the type used on various buildings, for example, on rectangular metal buildings which have spaced beam members arranged to form a roof having a ridge at the longitudinal centerline thereof, and spaced purlins spanning the beams to which the roof panels are secured.

Various methods of erecting such standing seam roof structures, and various roof panel assemblies such as those of the type illustrated in U.S. Pat. Nos. 4,168,596 and 4,106,250 have been proposed and various panel systems such as shown in U.S. Pat. Nos. 4,155,209; 3,535,844; and 3,667,180 have employed factory applied mastic as a water-proofing material. None of these prior constructions, however, have the combined attributes of the standing seam roof panel assemblies which presently will be described.

The present panel assembly incorporates matching mastic or "hot melt" material beads on the upstanding panel seaming edges, which may be applied at the factory in a predetermined bead volume along a protected pocket located interjacent the ends of each of the upstanding seaming edges in a predetermined location.

One of the prime objects of the present invention is to design a panel structure in which pairs of adjacent panel sheets, having upstanding mating seams adapted to be locked in a standing seam are so designed that the roof seaming operation which deforms the assembly extrudes the flowable mating mastic or "hot melt" material strips which have been applied to the panels at the factory into even the most minute crevices between the mating seams, to provide a completely water-tight joint.

Another of the prime objects of the invention is to provide the mastic or "hot melt" material in the form of continuous, longitudinal beads deposited in communicating, mating, seam pockets which protects the mastic during shipment of the panels from the factory to the job site in bundles.

The invention contemplates placement of the mastic in an optimum protected position on the upstanding seam edges in a manner such that the generally upstanding seam edges can slide against each other during transportation and erection of the roof panels without dislodging or damaging the mastic, the complemental mastic masses coming in contact only when the cap is installed and the cap and seaming edges are deformed during the seaming operation.

Still another object of the present invention is to provide a structure which can be used at a three or four corner panel intersection point to provide a water-tight structure and also at the ridge joint to provide a waterproof ridge joint.

The invention contemplates incorporation of the complementing mastic beads in the adjacent standing seam edges to be mated at a location below any notches which are made at three or four corner laps or elsewhere.

Still another object of the invention is to provide an assembly and method of the character described wherein mastic-to-panel adhesion and mastic-to-mastic cohesion are assured because of the manner in which the mastic beads are disposed in complementary relation in the seam edges to be mated and then squeezed during the seaming operation.

A further object of the invention is to provide a standing seam roof panel assembly of the character described which is easy and economical to erect, and can be easily and reliably unitized in the field, using a relatively simple seaming apparatus to perform the edge seaming operation.

Still another object of the invention is to minimize the necessity of the field application of gun grade mastic which may be inadvertently misapplied, or not applied at all, during the erection of the building.

Still a further object of the invention is to design a symmetric roof panel of the character described which will readily nest with like panels when bowed slightly to "open" it up, the construction lending it to an economical form of shipment in which the panels are strapped in a nested stack.

SUMMARY OF THE INVENTION

A prefabricated roof panel assembly for forming standing seam roofs and the like, wherein a pair of upstanding seam forming interlocking mating edges on adjacent sheets are each formed with opposed complementary pockets substantially the same distance down from their upper ends. Mastic or "hot melt" beads of predetermined volume are disposed in the pocket in each wall section, and squeezed into spaces between the seaming edges when the pockets are deformed during the seaming operation in which the seam edges are united in locked relation.

Other objects and advantages of the invention will be pointed out specifically or will become apparent from the following description when it is considered in conjunction with the appended claims and the accompanying drawings, wherein:

Figures 1, 2, 6:
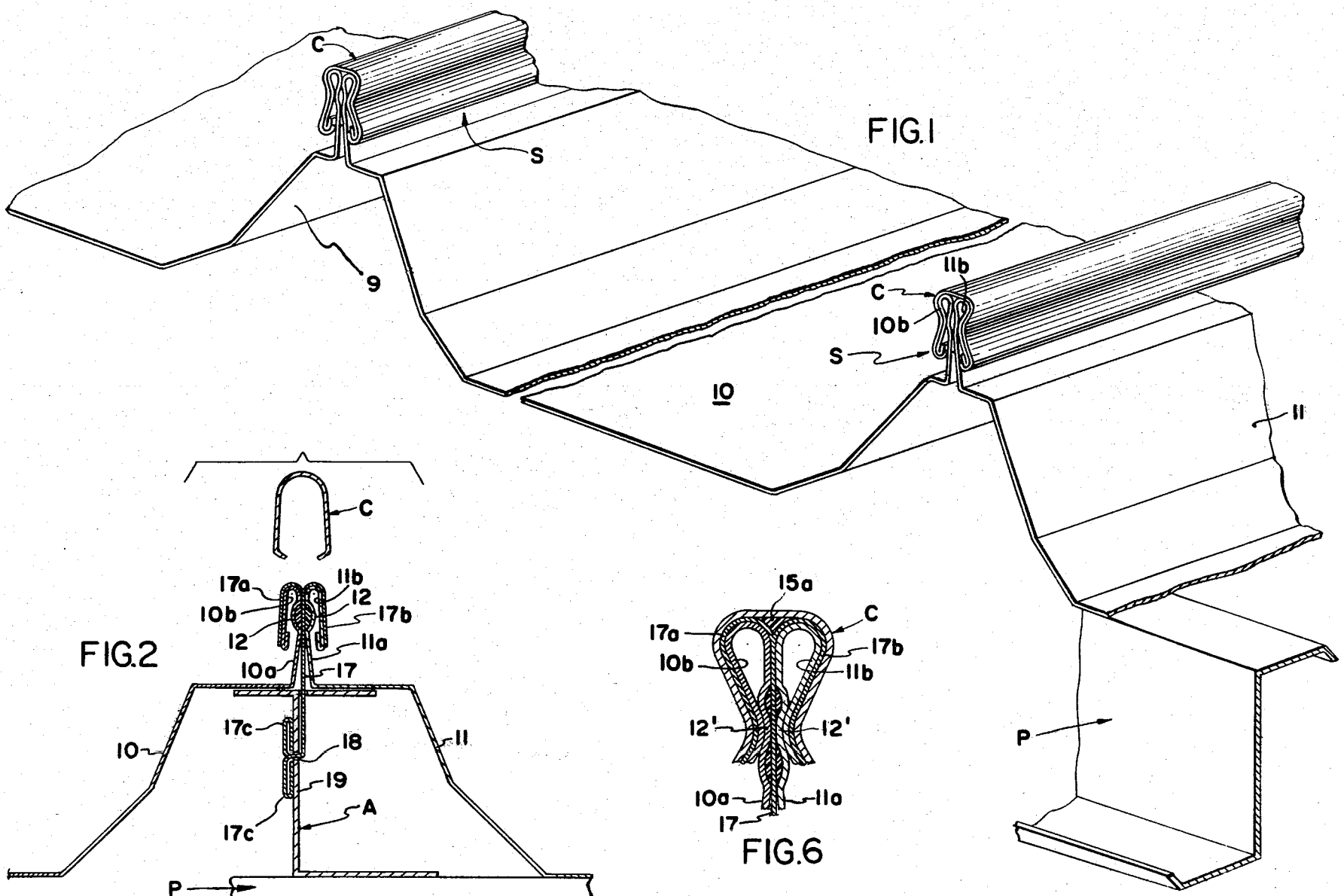
FIG. 1 is a fragmentary top plan view showing identical roof panels of the present design locked to one another by the standing seams which are formed.
FIG. 2 is an enlarged, exploded, fragmentary, transverse, sectional view illustrating a manner in which the roof panels can be secured to the roof purlins.
FIG. 6 is a similar view taken at one of the clip assemblies.

Referring now more particularly to FIG. 1 of the drawings, adjacent panels 9, 10 and 11 are shown assembled with their mating edges forming standing seams, generally designated S as shown. Metal clip assemblies A (FIG. 2) can be employed in a manner to be later described to secure the adjacent panels to the roof purlins P in any acceptable manner, such as by bolting the clip assemblies in place.

Figure 3:
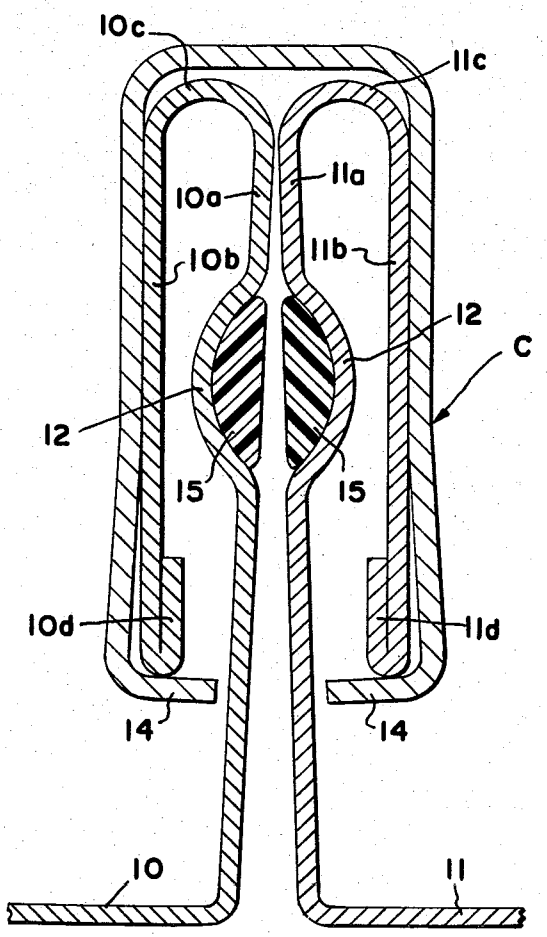

As FIG. 3 indicates, the adjacent upstanding seam forming adjacent edges of the elongate panels 10 and 11, which are generally designated 10*a* and 11*a* respectively, are provided with generally matching complementing opposed pocket-forming portions 12 for receiving factory applied mastic or "hot melt" material beads 15 which extend the full length of the panels. The "hot melt" material can be the synthetic resin manufactured by H. B. Fuller Company of Minneapolis, Minnesota, U.S.A., and applied to the metal roof panels in a "hot" state, i.e. 350° F. The material has excellent cold temperature flexibility. The panel edges also include reversely, bent downwardly extending portions 10*b* and 11*b*, which are connected with the portions 10*a* and 11*a* by curvilinear portions 10*c* and 11*c*, and formed with upturned edges 10*d* and 11*d*.

A generally U-shaped cap, generally designated C, is provided in enveloping relationship with the upper ends of the panel edges, and has lower flanges 14 which, as will become apparent, are snap-fitted under the portions 10*d* and 11*d* to begin with.

Figure 5:
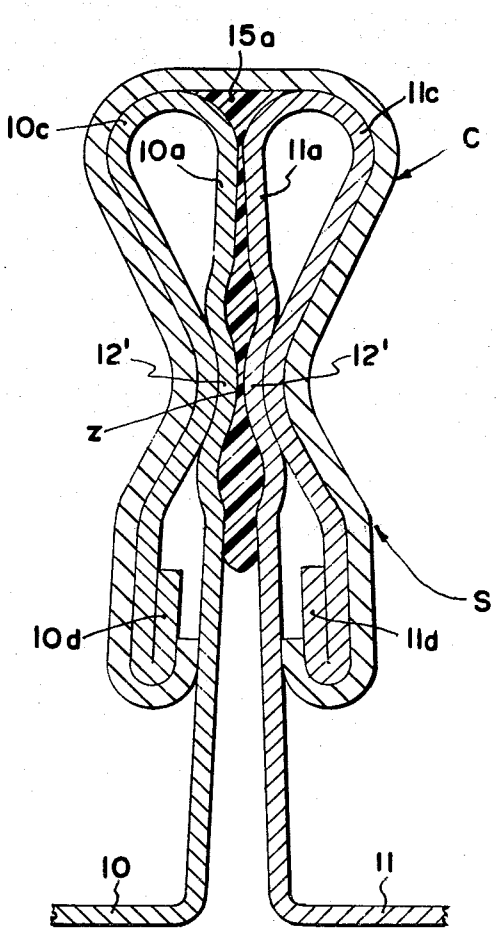
FIGS. 3–5 are greatly enlarged, fragmentary cross-sectional views taken at a point intermediate the clip assemblies shown in FIG. 2, illustrating the method of seaming the panel edges in progressive steps.

To complete the seaming operation, forces are applied by the seaming machine in the lateral directions "x" and "y" to the cap C seam edge portions 10*b* and 11*b*, and the pocket sections 12 in a squeezing operation which distributes the beads 12 in the manner indicated in FIG. 5. With the curvature of the pockets 12 now deformed, as at 12' (FIG. 5), so that they substantially engage at "z", mastic fills the spaces between the adjacent edges 10*a* and 11*a* both above and below the "z" area, and is further squeezed up into the area 15*a* at the top of the joint between the upper end of the cap C and the portions 10*c* and 11*c* of the panel seaming edges.

Figure 4:
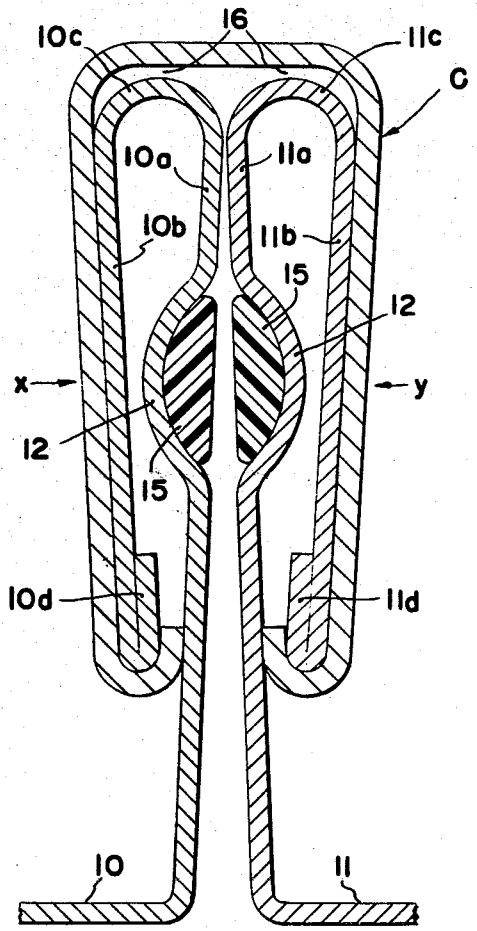

It will be observed, from an inspection of FIGS. 4 and 5, that the cap C, when assembled in the FIG. 4 condition, has spaces 16 between the cap top and the bridging sections 10*c* and 11*c* to permit the deformation which is shown in FIG. 5, and that, when the completed standing seam joint S is formed, as shown in FIG. 5, the cap side portions are in tight engagement with the portions 10*c* and 11*c* and the downturned walls 10*b* and 11*b*, over their length. When assembled by the method indicated, a completely waterproof joint is provided which will withstand even extreme weather conditions.

FIG. 2 illustrates a typical clip assembly A such as, for instance, may be used to tie the standing seams S to the purlins P at spaced intervals along the seams S. Here, the metal tie strip 17 has tabs 17*a* and 17*b* which are bent reversely to envelop panel edge portions 10*c*, 10*b* and 11*c*, 11*b*. The lower end of the tie strip 17 extends through an opening 18 provided in base clip part 19 and is provided with retainer loops 17*c*. Fig. 2 is an exploded view taken before cap assembly and seaming have taken place and is illustrative only of a construction which could be used. When the seaming operation takes place, the strip 17 is also encapsulated by the mastic and, as previously indicated, the mating seam edges are locked and prevented from separating to the extent that the mastic delaminates or fractures during the life of the roof structure when subjected to normal conditions such as expansion and contraction, heat and cold cycles, and the like. The clip assemblies A may be used at approximately two foot intervals. Because opposing mastic pockets were provided, a seal on both sides of the member 17 automatically occurs.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

I claim:

1. In a prefabricated roof panel for standing seam roofs and the like; a metal sheet, including a generally longitudinally extending roof panel portion having an upstanding seam forming edge along each side thereof which includes a wall formed with an externally facing pocket therein at a spaced distance downward from its upper end above said panel portion, the pocket being spaced downwardly substantially the same distance at each side so that the pockets of longitudinally adjoining such panels are opposed and open to one another; a pre-applied mastic or hot melt weatherproofing bead disposed in each said pocket and protected thereby, and a reversely bent contiguous wall extending downwardly from the upper end of each wall so that the pocket protrudes toward the reversely bent wall, the upper end of the edge being formed with a bridging portion connecting the two walls.

2. The panel of claim 1 wherein the terminal lower end of each reversely bent downwardly extending wall is bent laterally toward the wall with the pocket.

3. The panel of claim 1 wherein the panel is generally U-shaped in cross-section.

4. In a prefabricated roof panel assembly for forming standing seams and the like; a pair of adjacent sheets, each of which has an upstanding seam forming edge which is adjacent the other so as to provide matable portions; each edge including a wall formed with a complementing, communicating externally facing pocket therein at substantially the same spaced distance down from its upper end, the said pockets on adjacent seam forming edges being oppositely disposed and open to one another; a mastic or hot melt bead of predetermined volume disposed in the pocket in each wall; and a cap with a top and side walls embracing the seam forming edges of the sheets and configured to deform and unite them to merge the beads when a predetermined pressure is applied thereto.

5. The assembly of claim 4 wherein each seam forming edge has a reversely bent contiguous wall extending downwardly from a curvilinear bridging portion connecting it with the wall having the pocket.

6. The assembly of claim 4 in which the cap has inturned edges; there being a space between the top wall of the cap and the bridging walls of the seam forming edges to permit lateral deformation of the cap side walls in a deformation step.

7. In a prefabricated roof panel assembly for forming standing seams and the like; a pair of longitudinally adjacent sheet metal panel sheets, each of which has a generally longitudinally extending roof panel portion with an upstanding seam forming edge which is adjacent the other so as to provide matable portions; each edge including a wall formed with an externally facing pocket therein at a spaced like distance down from its upper end above said panel portion; a mastic or hot melt bead of predetermined volume disposed in the pockets; and means incorporated with the sheets for holding the seam forming edges in locked adjacent relation; the pockets being deformable laterally when a predetermined pressure is applied thereto to cause mastic to be delivered from the pockets to spaces between the seam forming edges to form a seal; there being roof support structure beneath said panel sheets and clips for connecting the seam and roof support structure extending up between said pockets at spaced intervals.

8. The assembly of claim 7 in which the means for holding the seam forming edges in locked relation includes a cap with top and side walls for embracing the seam forming edges, the side walls being deformable under said pressure laterally inwardly to a position locking the seam forming edges together.

9. The assembly of claim 8 wherein each seam forming edge has a reversely bent contiguous wall extending downwardly from a curvilinear bridging portion connecting it with the wall having the pocket, and the cap side walls have laterally inturned edges which extend under said reversely bent walls.

10. A prefabricated roof panel assembly comprising adjacent panel sheets having adjacent upstanding seam forming edges enveloped by a locking cap which unites them in locked relation to form a standing seam joint; the edges comprising upstanding walls with laterally displaced former mastic or hot material bead-carrying pocket portions squeezed together to provide oppositely disposed curvilinear walls in substantial engagement at one location spaced downwardly from the upper ends of the upstanding walls to form enlarged locking protrusions above and below the said area of substantial engagement; the mastic or hot melt material formerly carried by said pocket portions lying in a united mass in said protrusions between said upstanding walls and bridging them; and the cap having an upper wall and side walls squeezed together to provide locking sections conforming to said oppositely disposed curvilinear walls located between said protrusions.

11. The assembly of claim 10 wherein the upper ends of the upstanding walls of the panel sheet edges are provided with outwardly curved upper sections which mate with the cap walls except for a central space between the upper sections and cap upper wall; and said latter space is filled with said mastic or hot melt material and connected by said material to the material below.

12. A prefabricated roof panel assembly comprising: adjacent panel sheets having adjacent upstanding seam-forming edges united in a locked relation to form a standing seam joint; the edges comprising upstanding adjacent walls, one of which has a laterally displaced former mastic or hot melt material, bead-carrying pocket portion squeezed to at least partially crush said pocket portion and substantially engage the opposite upstanding seam-forming edge; the mastic or hot melt material formerly carried by said pocket portion lying in a united mass between said upstanding walls and bridging them.

13. The assembly of claim 12 in which the upper ends of the seam forming edges are embraced by a cap having an upper wall and side walls squeezed together to provide locking sections configured to hold the seam forming edges in locked relation.

14. The assembly of claim 13 in which each of the seam forming edges has a laterally displaced former mastic or hot melt material carrying pocket squeezed to at least partially crush the pocket portion to displace the material between the adjacent seam forming edges.

15. The assembly of claim 13 wherein the upper ends of the upstanding walls of the panel sheet edges are provided with outwardly curved upper sections which mate with the cap walls except for a central space between the upper sections and cap upper wall; and said latter space is reached by said mastic or hot melt material and connected by said material to the material below.

16. In a method of forming a standing seam with adjacent roof panel upstanding edges and a cap strip which envelops them; the upstanding edges each including an upwardly extending wall formed with a complementing communicating opposed pocket at substantially the same spaced distance down from its upper end; the cap having a top wall and side walls; and mastic or hot melt material beads provided in the pocket in each upwardly extending wall, the step of:

laterally squeezing the cap side walls simultaneously from opposite directions to deform portions of them interjacent their ends inwardly to form locking protrusions thereon, to deform portions of the reversely bent walls inwardly interjacent their ends to provide complementary locking protrusions thereon, and to deform the pockets to reverse their curvature to form mating interlocking protrusions thereon and squeeze the beads into a united mass to occupy and fill space between the upstanding walls.

17. The method of claim 16 in which the said mass has sufficient volume and is squeezed sufficiently to occupy space between the cap top wall and upper ends of the walls which had the pockets.

18. In a method of forming a standing seam with adjacent roof panel upstanding edges; one of the upstanding edges including an upwardly extending wall formed with a pocket at a spaced distance down from its upper end and the other edge having an adjacent upwardly extending wall; and mastic or hot melt bead material provided in the pocket in the upwardly extending wall, the step of:

laterally squeezing the walls simultaneously from opposite directions to deform the pocket and squeeze the bead to displace it to occupy and fill space between the upstanding walls.

19. The method of claim 18 in which a cap strip with a top wall and side walls envelops the upstanding edges and pocket, and the squeezing pressure is applied to the cap side walls to deform them to interlock with said upwardly extending walls, and the said bead has sufficient volume and is squeezed sufficiently to occupy space between the cap top wall and upper ends of the upwardly extending walls.

20. A prefabricated roof panel assembly comprising adjacent panel sheets having adjacent upstanding seam forming edges united in locked relation to form a longitudinally extending standing seam joint; roof support structure underlying said sheets; the edges comprising upstanding walls with laterally displaced former opposed mastic or hot material bead-carrying pocket portions squeezed together to provide oppositely disposed walls in near engagement at one location spaced downwardly from the upper ends of the upstanding walls; clips for connecting the seam and roof structure extending up between said walls at longitudinally spaced intervals; the mastic or hot melt material formerly carried by said pocket portions lying in a united mass between said upstanding walls and bridging them, and being disposed on both sides of said clips.

21. The assembly of claim 20 in which a cap with top and side walls embraces the seam forming edges to hold them in locked relation, the cap side walls being deformed laterally inwardly interjacent their upper and lower ends at the location of the former pocket portions, the mastic in said united mass also lying between said cap top wall and seam forming edges.

22. In a prefabricated roof panel assembly for forming standing seams and the like; a pair of adjacent roof panel sheets, each of which has an upstanding seam forming edge which is adjacent to the other so as to provide matable portions; each edge including a wall formed with a mastic containing pocket therein, open to the adjacent edge; the pocket mastic groove being deformable to urge the mastic against the adjacent seam forming edge so as to adhesively unite it therewith in an assembled mode of the roof panel assembly; and means for holding the two seam forming edges adjacent to each other in the assembled mode; each seam forming edge pocket being at substantially the same distance down from its upper end, the pockets being oppositely disposed and having a mastic or hot melt bead of predetermined volume therein.

23. The assembly of claim 22 in which the means for holding the seam forming edges includes a cap with top and side walls for embracing the seam forming edges, the cap side walls being deformable laterally inwardly to a position holding the seam forming edges together.

24. The assembly of claim 23 wherein each seam forming edge has a reversely bent contiguous wall extending downwardly from a curvilinear bridging portion connecting it with the wall having the pocket, and the cap side walls have laterally inturned edges which extend under said reversely bent walls.

* * * * *